US009956600B2

(12) United States Patent
Madhavan

(10) Patent No.: US 9,956,600 B2
(45) Date of Patent: May 1, 2018

(54) UNIVERSAL DIES OF CONTROLLABLE CURVATURE

(75) Inventor: Viswanathan Madhavan, Gaithersburg, MD (US)

(73) Assignee: Fairmount Technologies, LLC, Wichita, KS (US)

( * ) Notice: Subject to any disclaimer, the term of this patent is extended or adjusted under 35 U.S.C. 154(b) by 207 days.

(21) Appl. No.: 13/565,793

(22) Filed: Aug. 2, 2012

(65) Prior Publication Data

US 2013/0283880 A1 Oct. 31, 2013

Related U.S. Application Data

(60) Provisional application No. 61/514,218, filed on Aug. 2, 2011.

(51) Int. Cl.
*B21D 7/08* (2006.01)
*B21D 11/02* (2006.01)

(52) U.S. Cl.
CPC ..... *B21D 7/085* (2013.01); *B21D 11/02* (2013.01)

(58) Field of Classification Search
CPC ... B21B 2031/026; B21B 31/16; B21D 11/02; B21D 7/085
USPC ..... 72/166, 169, 172–174, 189–191, 195, 72/199, 205, 250, 251, 422, 465.1, 466, 72/466.2, 466.3, 466.6, 466.7, 466.8, 72/466.9, 470, 473; 198/813
See application file for complete search history.

(56) References Cited

U.S. PATENT DOCUMENTS 1,351,472 A * 8/1920 Farmer ..... B21D 7/085 72/171
1,985,501 A * 12/1934 Hudson ..... B21C 47/08 261/DIG. 55
2,457,483 A * 12/1948 Martin ..... B21D 7/06 72/297
2,514,830 A * 7/1950 Bath ..... B21D 11/02 72/151
2,533,470 A * 12/1950 Kapelis ..... B21D 7/06 72/380
2,569,266 A * 9/1951 Thompson ..... B21D 7/10 72/166
2,729,265 A * 1/1956 Jones ..... B21D 9/05 29/413
2,888,973 A * 6/1959 Yurka, Jr. ..... B21D 11/02 72/397
3,342,054 A * 9/1967 Bond et al. ..... 72/238
(Continued)

FOREIGN PATENT DOCUMENTS

JP 62279030 A * 12/1987

OTHER PUBLICATIONS

Machine Translation of JP62-279030A.*

*Primary Examiner* — James S McClellan
*Assistant Examiner* — Peter Iannuzzi
(74) *Attorney, Agent, or Firm* — Maier & Maier, PLLC

(57) ABSTRACT

A flexible but strong universal die is disclosed, that is flexible enough to be elastically deflected into different curvatures by actuating forces and moments, while being strong enough to support the die forces and moments that it has to apply to parts to form them to the shape corresponding to its shape. A design of the die and actuation locations that makes it easy to deflect it into different constant curvatures, as well as into shapes with gradients of curvature along the length of the die, and the use of these dies for stretch roll forming are disclosed.

16 Claims, 6 Drawing Sheets

(56) References Cited

U.S. PATENT DOCUMENTS

| | | | | | |
|---|---|---|---|---|---|
| 3,525,247 | A * | 8/1970 | Demetriades | B21D 11/02 | 72/18.1 |
| 3,559,439 | A * | 2/1971 | Zak et al. | B21D 7/04 | 72/153 |
| 3,702,072 | A * | 11/1972 | Broderick | B21D 47/00 | 72/307 |
| 3,952,572 | A * | 4/1976 | Mergler | B21D 7/03 | 72/298 |
| 4,080,815 | A * | 3/1978 | Foster | B21D 5/08 | 72/168 |
| 4,450,708 | A * | 5/1984 | King | B21D 11/10 | 72/295 |
| 4,545,229 | A * | 10/1985 | Stepanenko | B21B 1/16 | 72/73 |
| 4,878,369 | A * | 11/1989 | Apps | B21D 11/14 | 72/18.7 |
| 4,989,439 | A * | 2/1991 | Ewert | B21D 25/02 | 72/296 |
| 5,005,396 | A * | 4/1991 | Desmet | B21D 22/10 | 72/309 |
| 5,214,951 | A * | 6/1993 | Waddell | B21D 9/03 | 72/297 |
| 5,224,370 | A * | 7/1993 | Morita | B21D 37/02 | 72/413 |
| 6,007,319 | A * | 12/1999 | Jacobson | B29C 47/0021 | 425/140 |
| 7,293,445 | B2 * | 11/2007 | Lev | B21B 1/22 | 72/167 |
| 2010/0050727 | A1 * | 3/2010 | Botta | B21B 39/08 | 72/205 |
| 2010/0263424 | A1 * | 10/2010 | Madhavan | B21D 5/08 | 72/166 |

* cited by examiner

UNIVERSAL DIES OF CONTROLLABLE CURVATURE

CROSS-REFERENCE TO RELATED APPLICATIONS

The present patent application claims benefit and priority to U.S. Prov. Pat. Appl. No. 61/514,218 entitled "Universal dies of controllable curvature" and filed on Aug. 2, 2011 which is hereby incorporated by reference into the present disclosure.

BACKGROUND OF THE INVENTION

Technical Field

The subject matter includes flexible but strong dies that can be used as dies for forming large extrusions, sheets and the like, of small curvature, the curvature of the dies being controllable by the application of much larger actuation forces and moments than the die forces and moments arising from the forming process.

Background Art

Metal forming dies, such as dies used for stretch forming of extrusions and sheets, are usually single monolithic pieces made of metals, plastics, wood, etc. The die geometry is fixed during the process of fabrication of the die. The shape of the dies is imposed on the part by the forming process. However, a separate die of the appropriate geometry is required for forming each part.

Recently, reconfigurable dies made up of an array of hydraulic cylinders which help define the position of the sheet are known. However, these use an interpolating layer of urethane which is flexible enough that it only serves to smooth out the bumps that would be produced by the hemispherical surfaces on the ends of the cylinders. The interpolating layer is not strong enough to define the geometry over a free length, and support the forming loads experienced over this length.

BRIEF SUMMARY OF THE INVENTION

The universal dies disclosed here contain at least one "active area" whose curvature can be changed, and in addition, may contain other locators and guide surfaces for part guidance, actuators for force application, etc. Each "active area" is made of one or more nested layers of strong but flexible beams or shells, preferably made of one or more materials capable of sustaining high elastic (recoverable) limiting strains without permanent (plastic) deformation such as Al 7075-T6, Titanium grade 5, PTFE, HDPE, polyimides, etc. Parts are either formed over the outer surface of the universal die or in between the outer surfaces of two mating pairs of universal dies with opposite (concave and convex) curvatures. The outer surface may be covered with a compliant material, to compensate mismatch between the curvature of the die and the part, and spread the die forces uniformly over the part. In another embodiment, the entire universal die may be circumscribed by a belt whose backing serves as a compliant material.

The curvature of "active areas" of these universal dies can be changed by the application of actuation forces and moments by external actuators. The outer surface of the universal die may preferably have a curvature that is in the middle of the range of curvatures that the die is expected to assume. The cross-section shape (especially the thickness) of each layer may be chosen according to the maximum change in curvature that is desired to be achieved/accommodated by elastic deformation of the die elements. The number of layers may be chosen according to the maximum die forces and moments (also referred to as die loads, which includes normal stresses and shear tractions) that are required to be supported by the universal die while forming the part.

For elongate parts that are predominantly bent in one plane, the active areas could be lengths of beams made of materials with high elastic limiting strains. For parts requiring to be bent to required curvatures in two orthogonal planes, the active areas will comprise of shells made of high elastic limiting strain materials, to permit changes in curvature of the die elements in two planes.

BRIEF DESCRIPTION OF THE DRAWINGS

These and other aspects will now be described in detail with reference to the following drawings.

DETAILED DESCRIPTION OF THE INVENTION

Figure 1:
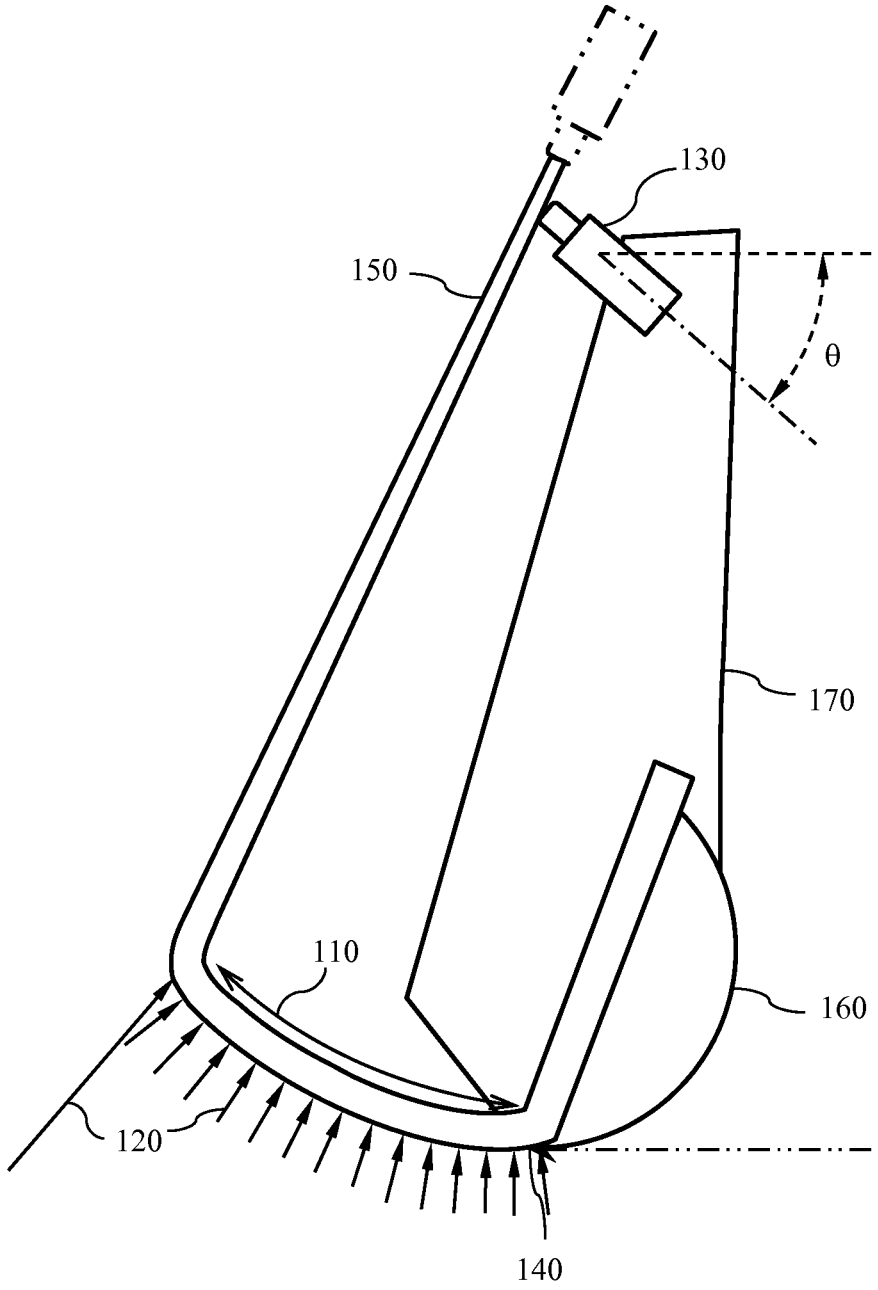
FIG. 1: Schematic sketch of curvature adjustable universal die, with an active length 110, cantilevered on one end 140 that is tangent to the incoming part, by fixation into a base plate 170, and actuated by a nearly constant moment load on the other end. The long bending arm 150 is used to translate the force exerted by actuator 130 into a constant moment over the active length. Forces 120 exerted by the clamping action and the belt tension are also shown. Note that the curvature of the active length is expected to be smaller in SRF applications, but is here shown exaggerated for clarity. (Drawing not to scale).

FIG. 1 shows one possible design of a curvature controllable universal die and a method for controlling the curvature of the same. The universal die has a small active length 110 in the middle which engages with the part to incrementally form it to the desired curvature. As shown in the figure, the active length 110 is a curved beam made of a strong, but flexible, material (of high elastic limit strain beyond which plastic deformation sets in). The active length of the die is fixed (cantilevered) to a ground plate 170 on the right side such that the tangent to the active length at this point 140 is substantially horizontal, along which the part being incrementally formed comes into the die. The other end (the 'free' end) of the active length has a long bending arm 150 that permits application of a nearly constant moment load along the active length 110 of the beam. The die 110, cantilevered end 140 and long bending arm 150 could all be machined out of one piece of metal with generous radii to avoid stress concentrations. In the figure the die 110 is shown as having a nearly uniform section, so that the change in curvature everywhere along the length of the beam is constant in response to a constant moment load. Note that the beam's thickness to length ratio is very high, that such a beam would normally be not thought of as a flexible beam. It can support substantial loads 120 due to clamping forces, belt tension, etc., without substantial change in curvature. The long bending arm 150 is acted upon by an actuator 130 that is also fixed to the ground plate 170 and is capable of applying substantial forces to deflect the active length 110 into different curvatures. The actuator 130 applying the actuation force to the long bending arm is positioned at an angle θ such that the moment arm decreases from the free end to the cantilevered end. This gradient of moment along the length of the beam cancels out the gradient of moment set up by the normal forces and tractions applied on the die surface. It could also be the case that the beam can have a variable section moment of inertia along its length to compensate for any residual (net) gradients in bending moment.

These universal dies 220, and belts sliding over these dies 250, can be used to apply normal and shear tractions to extrusions and sheets to simultaneously stretch and form local regions to desired membrane stretches and curvatures in the CNC stretch forming process that is also known as Stretch Roll Forming. The advantage of these curvature controlled universal dies is that the curvature can be adjusted to the appropriate value required to impart the required curvature to the current region of the part that is being formed, and so these dies can be used to apply tractions over a larger length of contact between the part and the dies 110 (which is also the contact area per unit width of the belt). The larger contact length in turn permits proportionally larger shear and normal fractions per unit width of belt to be applied to the part by a single universal die/belt, since with strong belts (reinforced with fibers such as Kevlar) the limiting fraction stress of the coating (or matrix or backing) of the belt is the factor that limits the traction. For instance, if a belt with a working strength of 1000 N/mm width is used, if the working shear strength of the backing is 14 $N/mm^2$ (2 ksi), the contact length will have to be 1000/14=71 mm to use the full capacity of the belt and transfer the maximum traction possible to the part. This is not possible to do if there is a large mismatch between the curvature of the dies and that of the region of the part being clamped by the die (if the backing were compliant enough this could be doable, but it will then not be strong enough to sustain a working shear strength of 14 $N/mm^2$ like assumed above).

Figure 2:
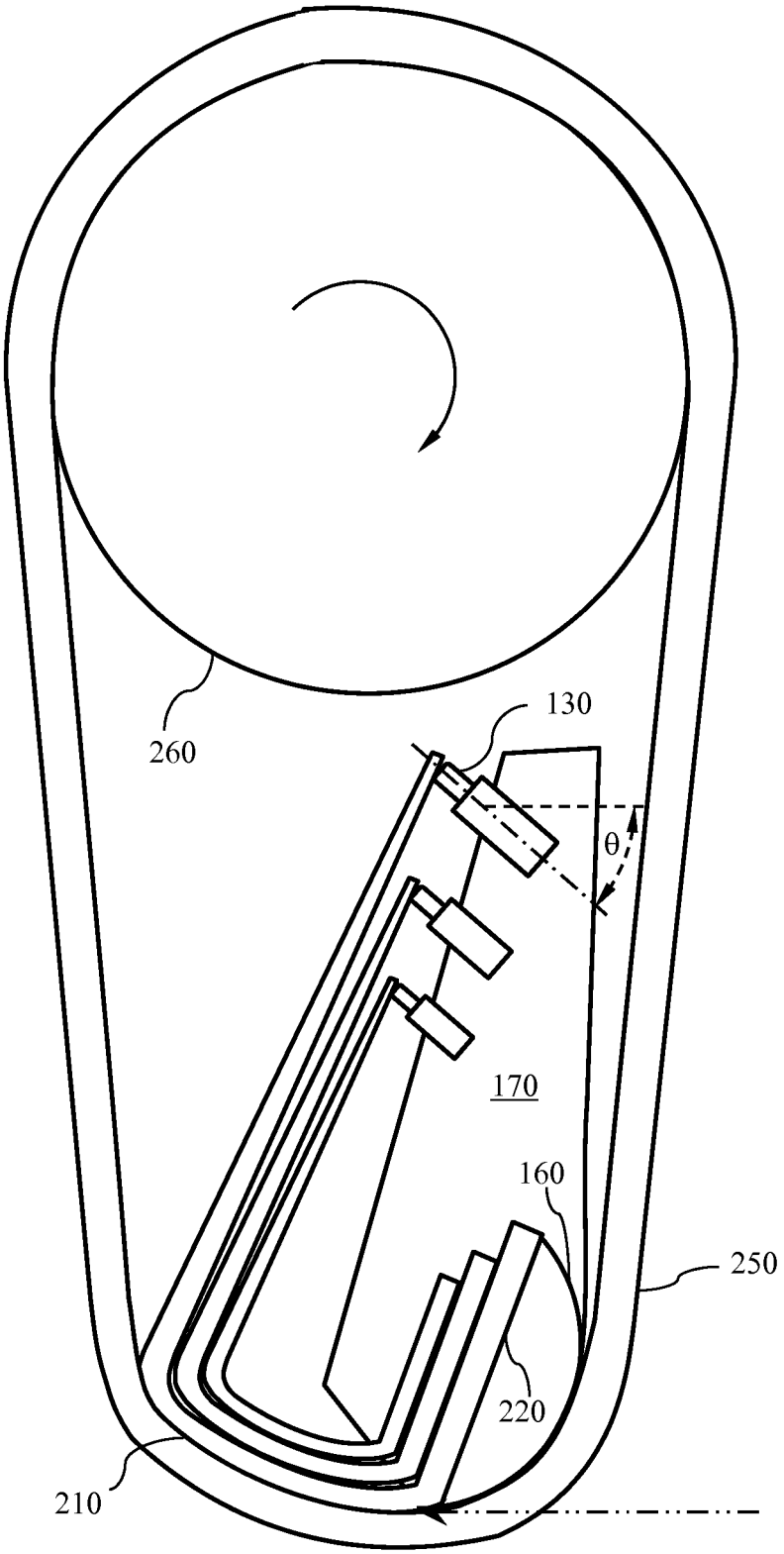
FIG. 2: Schematic sketch of the basic principle of action of an universal die in concert with a belt to apply traction to a part. The belt 250 is driven by drive pulley 260 around an outer die layer 220 having an outer surface of die 210. One or more belt guides 160 are used to guide the belt around sharp corners. Base 170 to which the actuators and one side of the flexible dies are fixed is also shown. The neutral shape of the die is convex (drawing not to scale)
Figure 3:
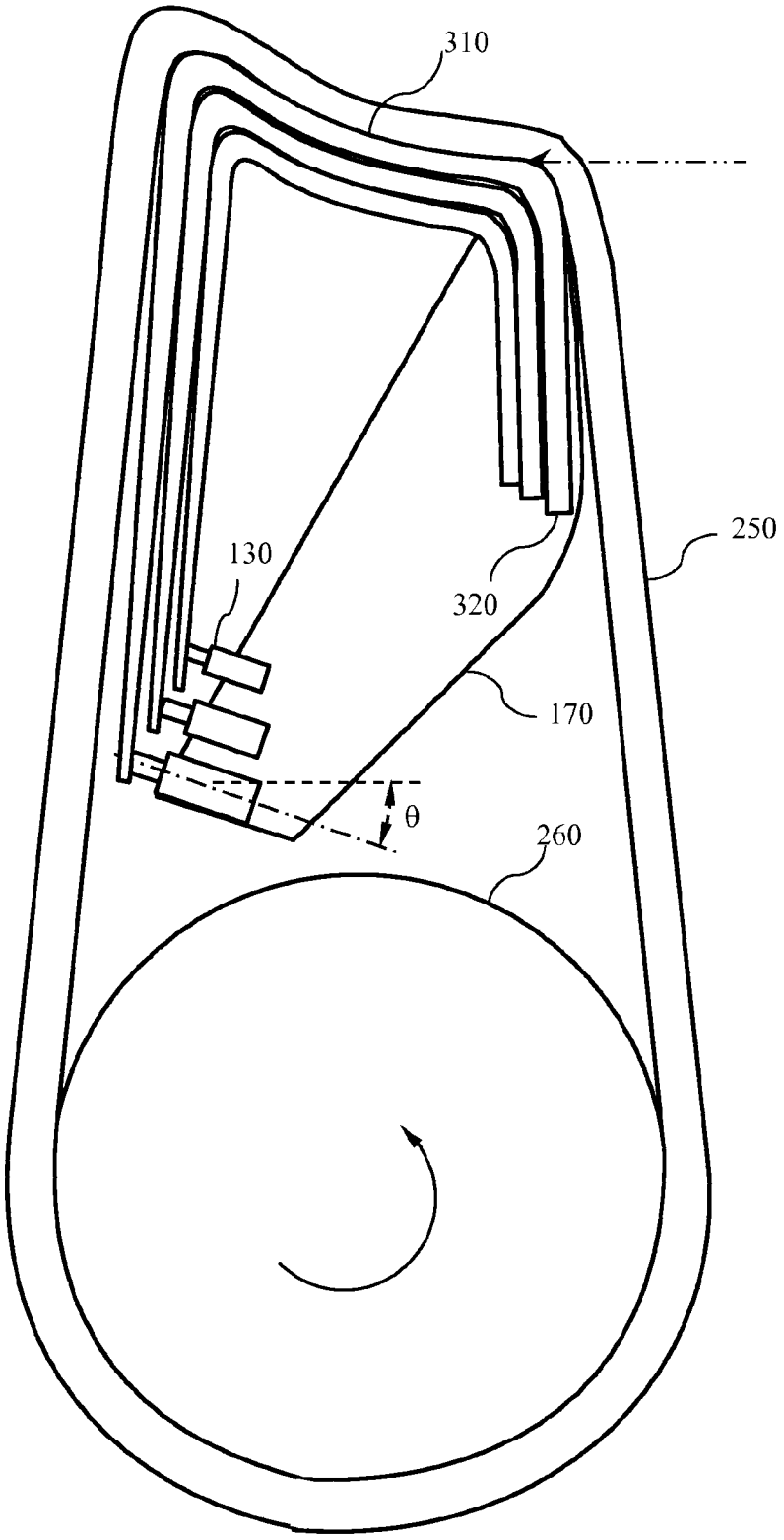
FIG. 3: Schematic sketch of a concave universal die that would mate with a convex universal die. The belt 250 is driven by drive pulley 260 around an outer die layer 320 having a concave outer surface 310 (drawing not to scale)

One possible design of a universal die with multiple nested dies is shown in FIG. 2 and FIG. 3. For ease of manufacture, this could be made by cutting out the grooves shown between the nested dies using wire EDM, (if the surface finish is not fine enough, may need to possibly polish the cut grooves using a process such as abrasive flow machining or coat the grooves' surfaces with a thin lubricious coating layer such as PTFE), and then inserting strips of PTFE between the layers. Note that, as the location of one or more actuation points moves farther away from the die surface, the relative ratio of the bending moment to the shear force increases, causing the curvature to become nearly uniform. By changing the location(s) and direction(s) of action of the actuation, the bending moment may be caused to increase or decrease along the length of the die, causing the curvature to vary proportionately along the length of the die. By varying the thickness of each of the layers, the bending moment required to bend those layers can be made smaller, while the cumulative thickness helps support larger normal (clamping) stresses.

Figure 4:
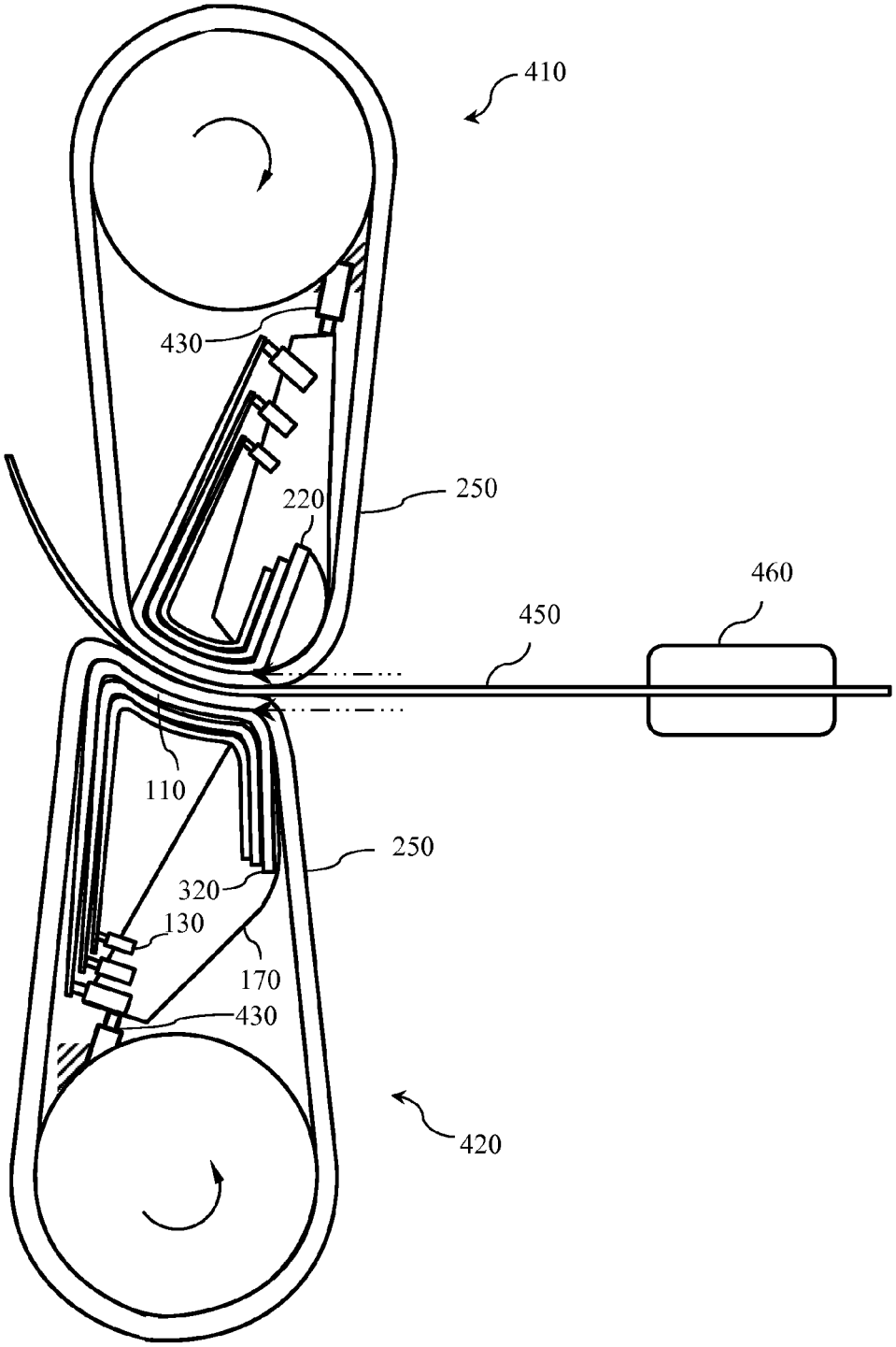
FIG. 4: Two curvature controlled universal dies stretch bending an extrusion; the sketch is not to scale. The drawing shows first convex universal die 410 being clamped against second concave universal die 420 by external actuators (clamping cylinders) 430. Brake station 460 brakes the movement of extrusion 450. Note that the actual curvature of the universal dies will be smaller and the drive pulley will be smaller so that there will be no interference between the formed part and the belts. (Drawing not to scale)

The neutral curvature is the curvature of the die in the unloaded condition. A pair of dies would have opposite neutral curvatures as shown in FIG. 4, the magnitude of the curvatures being slightly different to accommodate the required thickness of the part and the pair of belts applying tractions on both sides of the part.

The following calculations can be used to decide upon the thickness of a material that can be used for making the universal dies. Titanium grade 5 (Ti-6Al-4V) has a yield strength of 1.1 GPa and elastic modulus of 114 GPa. So its yield strain is of the order of 1%. Say the die has to accommodate a range of radii from 30 inches to 84 inches.

$0.01>\text{Bending strain}=t/2*(\Delta\kappa)=t/2*(1/r_{n1}-1/r_{n2})=t/2*(1/30-1/84)=t/2*0.021=t*0.0107$ which implies that $0.01>0.0107\,t$ which implies that $t<0.93$ inch. If the range of curvatures can be smaller, or if the beam is deflected both sides, starting from a base curvature of $(\kappa_1+\kappa_2)/2=(1/30+1/84)/2=0.045/2=0.0226$, i.e. a radius of curvature of 44.2 inches, then the thickness can actually be double this. For this kind of thickness, even just one strip will be sufficient to support all the normal loads and shear tractions exerted by the belt+the clamping load on the die. The ratio R/c where R is the radius and c=Ymax (the distance to the extreme fiber from the neutral axis) is about 40 for the above numbers. From Roark's formulas for stress and strain ($6^{th}$ Ed., Pg. 236), it is clear that by the time R/c is more than 10, the deviation from a straight beam is small.

The following is an example of a simplified calculation of the deflection of the die due to the normal clamping stress, the belt tension and the shear traction. Assuming that the die is clamped on one side as shown in the figures, the bending moment due to forces 120 will be greatest at the fixed/cantilevered end 140. Formula for max bending moment due to uniform normal clamping stress of 5000 psi (35 MPa), shear fraction of 500 psi (3.5 MPa due to a coefficient of friction of 0.1 between the belt and the die, which can be neglected in comparison to the normal stress), and a total belt force of 1000 N/mm (to be conservative assume that the belt force is applied at the tip of the beam, perpendicular to the length of the beam). The max bending moment=$1000*75+wL^2/2=75{,}000+35\ N/mm^2*75^2\ mm^2/2=75{,}000+196{,}875$ N-mm/mm=272,000 N-mm/mm width of belt. For a 1 mm wide belt and die, the moment of inertia is $I=1/12*1*23^3=1014\ mm^4/mm$. $E=114000\ N/mm^2$; This max bending moment will cause a max bending stress of S=(M/I)*Ymax=3.2 GPa and a change in curvature of Δκ=M/EI=272000 N-mm/mm/(114000 N/mm$^2$*1014 mm3)= 1/425 mm⇒R=0.4 m=16.7 inch. The stress is beyond yielding and the change in curvature is quite significant.

Figure 5:
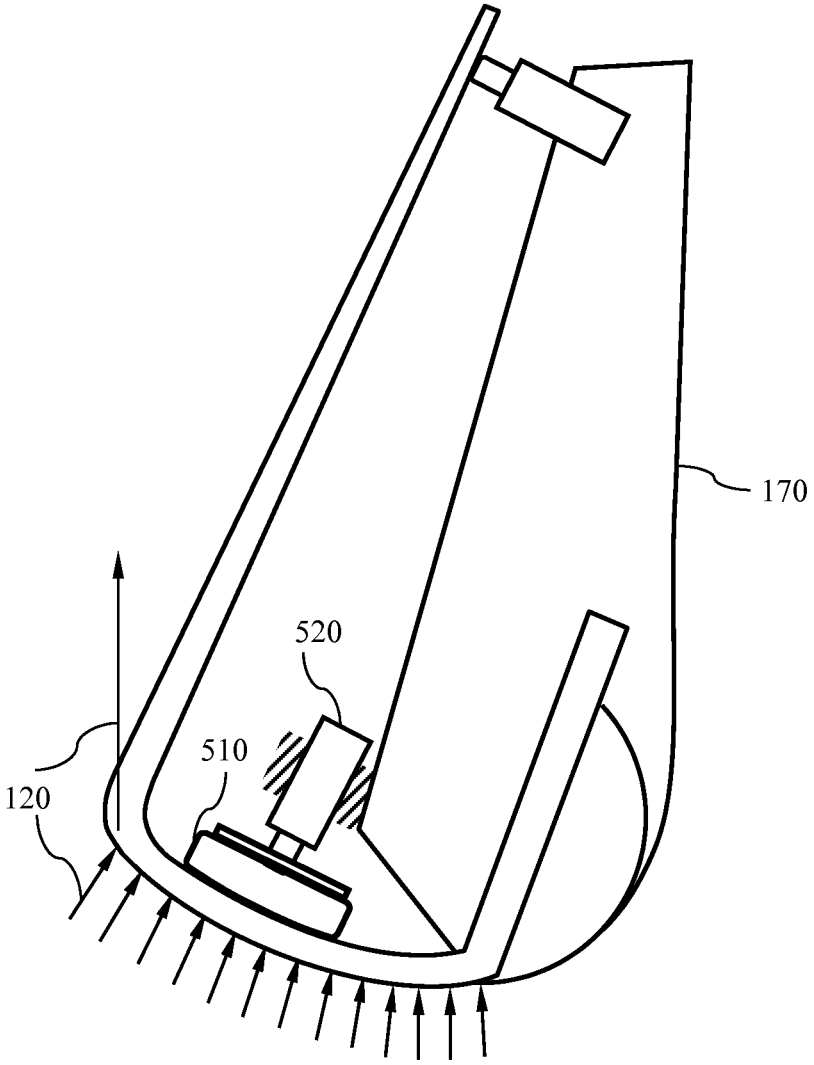
FIG. 5: Use of a second actuator 520 directly on the active length of the die through compliant material 510, to support the clamping and belt forces 120. (drawing not to scale)
Figure 6:
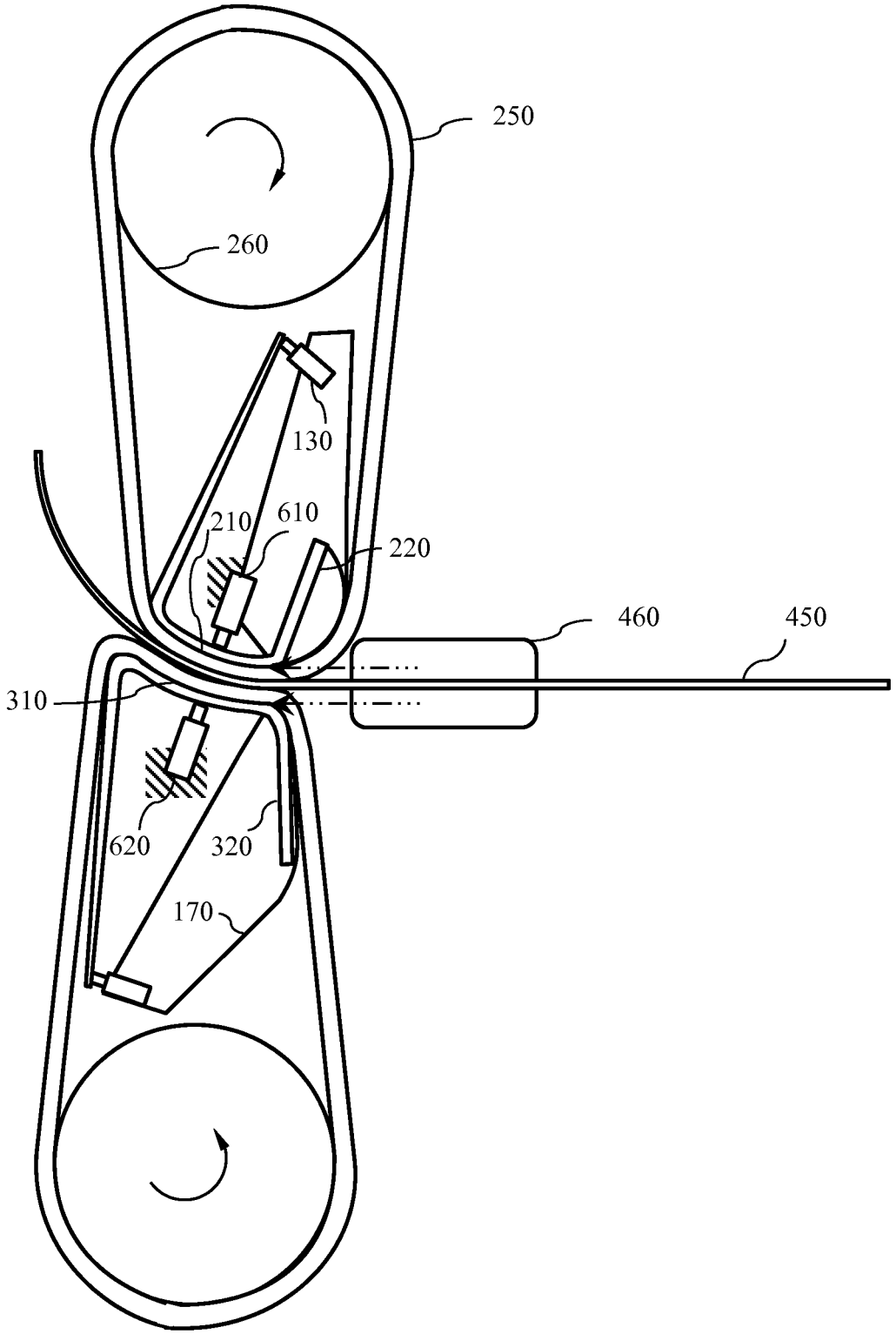
FIG. 6: Two opposing universal dies that are clamped together across the active lengths (beams) by actuators (opposing clamping cylinders 610 and 620) connected to the overall ground for the station, forming a station. The drive pulleys also serve as the tensioning pulleys. Note that the free length of extrusion between the brake station and the traction station can be minimized to prevent unconstrained bending or buckling of the material in this length. Also note that the brake station can be another station similar to the first one shown, in which the belts are driven in directions opposite to those shown for the first station, to pull the part (the extrusion) in the opposite direction

The change in curvature can be substantially decreased by actuating the long bending arm in two orthogonal directions, one of which is substantially along the arm (the actuator shown using phantom lines in FIG. 1). The actuator along the length of the long bending arm can be used to oppose the belt loading and the distributed clamping force, substantially reducing the effect of these on the curvature of the active length of the die—i.e. the "free" end will no longer be free, but be "simply supported". Another even simpler solution will be to use the second actuator 520 to directly support the active length of the die, either at an "Airy" point or via a compliant insert 510 (as shown in FIG. 5). This actuator will react the total clamping force and belt tension. In fact, this actuator could be used to clamp the two pairs of dies together (as shown in FIG. 6), without actuating the base plates on the two sides in opposite directions (as in FIG. 4).

Change in curvature as well as the maximum stress can also be reduced by a factor of 8 by doubling the thickness of the beam, using the middle curvature as the natural curvature, and using both sided actuation of the actuator. For beam thickness=46 mm, I=8112 mm^4; Δκ=1/(8*425 mm)=1/3.4 m=1/136 in. Max stress=400 MPa, well within the yield of Ti-6Al-4V.

This can be further reduced by making the fixed point the middle of the curved die and deflecting both free ends equally. This will cause the effect of the normal stress and the belt tension to be reduced by a factor between 2 and 4, without significantly affecting the flexibility of the die. However, the whole die structure will have to be rotated to make it tangential to the incoming extrusion—this will require a heavy rotary table bearing and a high torque drive.

The width of the beam can also be made twice the width of the belt—this will also further reduce the effect of these external loads. Note that the hydraulic actuator will need substantial force and stroke capacity to deflect these dies. For fixed dies such as those needed to build the T-section fuselage ribs for Cessna, one can even use a screw based adjustment to adjust the curvature of the die to obtain the desired curvature of the parts.

Note that by appropriate design of the angle of the actuator (as mentioned below), one can get to a point where the position of the actuator can be directly related to the constant curvature of active surface of the die. This will then be very easy to implement in practice.

The angle at which the actuators apply the force can be changed so that the bending moment due to the actuator is highest at the free end 150 and decreases towards the clamped end 140. This second variation can be made to exactly counteract the first one (due to die loads 120) by orienting the cylinder appropriately, so as to cause the bending moment to be constant, i.e., the curvature of the die to be constant. Note also that the angle of application of the force can be varied to produce any desired variation in curvature along the die surface. Also, instead of varying the angle, a second actuator at 90 degrees to each actuator can be used to apply forces in two orthogonal directions. The plane of action of these two actuators can also be independently adjusted to be above or below the centerline of the die to counteract the twisting moment that will be caused by one another being off centerline, and any other twisting moment one the die, for instance, due to the clamping forces being applied only along the bottom or along the top of the active surface (curved portion) of the die, as will be the case when a T-section or L-section is being pulled by the flange (cap).

Feedback control of the die curvature can be accomplished based on measured part curvature.

FIG. 4 shows two complementary universal dies 410 and 420 at a station, that are used to stretch the length of a part 450 between the station and a separate brake station 460 that opposes the tractions exerted by the belts around the universal dies. If each of the two belts can apply 1000 N/mm traction to the part, assuming that the fraction of the C.S. area of the extrusion over which traction is applied (i.e. only cap is pulled on; the leg is not pulled) is ½, this means that 1000 N/mm traction can be applied over the entire length of the part. For even 7075-T7 parts, the Yield is about 75 ksi=516 Mpa, which implies that nearly 2 mm thickness (0.08") wall thickness of the extrusions can be handled in one stage itself.

Multiple stations similar to those shown in FIGS. 4 and 6 can be used to apply cumulatively larger tractions to parts. The maximum distance between successive stations should be small enough compared to the radius of curvature and the thickness of the segment of the part between the stations so that the bending moment due to the stretch force within the work piece, that acts to further bend or unbend the section, is small compared to the bending moment required to form the section to the required radius of curvature. In between the brake station and the first traction station, where the stretch force is high enough to plastically deform the part in tension, only a small bending moment is required to form the part. This small bending moment is provided by a small difference in the normal force applied by the two opposed universal dies at the first traction station and the bending to the curvature occurs at the inlet to the first traction station as shown in FIG. 6. By controlling the curvature of the universal dies, as well as the tractions applied by the belts, controlled curvatures can be imparted to the part in both orthogonal planes containing the length of the incoming part as well as a twist about the longitudinal axis of the part. In the case of all the prior art, tractions are exerted between stations which are substantially displaced along the length of the part. If forming of the part to a curvature were to be attempted with such stations, it would actually cause the part to get straightened out—i.e., the stretch force between stations would straighten the bent part. This is the case because the size of the rolls needs to be high in order to apply the substantial normal and traction forces required in one station. Without the use of progressive buildup of the tractions via a number of small rollers and/or traction elements, which serve to increase the stretch force while eliminating the bending moment that tends to straighten out the part, stretch forming to deterministic contours is impossible. The distance between the stations should in general be not more than a few times the depth dimension of the profile. In all prior art where either a sweep or a curvature in the plane have been claimed, this is achieved only by bending, not stretch bending.

Even if a total contact length between the belt and the extrusion of 6" instead of 3" were used (i.e. a factor of safety of 2.0 to ensure that the traction can be transferred from the belt to the extrusion without slipping at the interface), a single well supported flexible die as in FIG. 6 may be sufficient. Otherwise 2 or 3 layers of flexible dies can be used to help take up the normal stresses as shown in FIG. 4.

Another approach is to apply clamping forces on the web (or stem or leg) that remains flat and apply traction to it while using a flexible die to guide the extrusion and the belt along the instantaneous curved path of interest.

If sand particles or steel shot were included into the elastomer or polymeric coating of the belt, this will help impart a shot-peened finish to the extrusion that industry can readily recognize and accept. The indents will also increase the traction that can be transmitted to the extrusion at lower clamping forces. Metallized fibers can be used to produce woven endless belts, which will have a higher friction to the part. This will also permit the use of a smaller clamping stress.

Woven endless belts with Kevlar reinforcement and polyimide or other higher temperature resins as the matrix will allow hot forming of the parts (sheets/extrusions). This may also increase the friction coefficient. Hot forming allows the material to deform more without cracks developing (either macroscopic cracks, or micro-cracks by mechanisms such as precipitate shearing), which will help preserve the fatigue life even for parts requiring large deformations. In-process heating of the part being formed (for instance, using heated rollers touching the extrusion in between the brake and the first traction station), and cooling the part immediately beyond the forming region (i.e. the first traction station) will minimize undesirable metallurgical changes.

The greatest benefit of incremental forming for aerospace applications is the ability to control the stretch to be uniform or vary in a pre-determined manner all over the part. A 5% uniform stretch will decrease the weight per unit length by 5%. Further, if this stretch led to work hardening of the material by 5%, the total weight saving will be 10%.

Parts may also be alternately compressed and stretched so the geometry does not change much, but the strengthening is significant, since the equivalent strain is cumulative. Note that the free length between the die and the brake station, in which forming happens, can be minimized, permitting significant compression without danger of buckling. This may also lead to highly workhardened product, such as is the goal of severe plastic deformation processes (such as ECAE), and can produce very small grain size materials, leading to much higher strength and significant weight reduction.

In order to carry out feedback control of the process, the machine can include one or more models of the stretch forming process that take the material type, properties, profile of the cross-section etc. as inputs and predict the amount of springback, and use this to set the die curvature required in order to get the finished radius desired. The machine can also have a radius monitoring method (using three or more point-position sensors or a line-scan sensor to sense the profile over a length from which the average radius of curvature of the profile can be calculated. This will have to be done at the exit of the extrusion when springback has occurred). If the measured springback is different from the model value, the model can then updated. Update can occur instantaneously and be effective during the formation of the rest of the first extrusion itself or it can be applied from the next part onwards. Model update can also use the actual properties measured (based on the torque required for a given amount of stretch). The model can also be used to compute settings for re-work of parts to fine-tune the geometry—if the first pass did not get to the exact geometry because of springback, deviations from expected and actual radii can be used to recalculate the new forming radius and reform the part to the required radius with a minimum amount of additional stretch. This will be especially useful for high cost materials and high value parts.

The frictional torque can be measured during a tuning process, when a part is gripped and moved back and forth without any brake (stretch) force. Since there is no stretch force, the only force the system is working against is friction. This testing can be used to build a comprehensive model for friction as a function of operating conditions, such as belt tension and die curvature.

For measurement and documentation of the strength as a function of position along the extrusion, it is better if a continuous loop of roller bearings were used between the die and the belt—as this will reduce the friction component of the torque and make it more consistent—the friction will be independent of the torque or the stretch force exerted at a station. The machine, with feedback control of the motor torques to maintain speed and stretch constant, and preferably using rolling elements at all possible locations to decrease friction, can actually be used to record the stretch of each station, as well as to record the load required to stretch that section to 3%; i.e. the machine also acts like a high resolution UTM (especially if friction between the belts and the dies is minimized), noting the stress for a certain strain at each length of the extrusion.

This can be used to measure the stress-strain curve of an initial length of the extrusion coming in, wherein the extrusion is "locked" in place at the inlet side encoder and the stress-vs. strain curve is measured by slowly stretching so the measurement of the outlet side encoder increases. Using the measured stress-strain curve, and models for the bending moment and springback, the expected bending moment and springback at any point of the extrusion can be estimated based on the curvature at that location.

The model can include the bending moment caused by the distance between the stretch force application region (for instance, the flange) and the center of inertia of the section through which the stretch force has to pass for pure stretching. The models can be refined by constantly measuring the actual curvature produced and comparing with the curvature estimated from the model and using this to update parameters in the model. Bayesian updating can be used with the current model parameters as priors to reduce the sensitivity of this update to noise.

A model for belt contact stiffness changes (for instance, due to slow degradation of the belt over time) can also be derived based on the response of the belt to torque or the belt compression measured during clamping at different forces without any extrusion in between.

ADDITIONAL NOTES

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown and described. However, the present inventor also contemplates examples in which only those elements shown and described are provided.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls. In this document, the terms "a" or "an" are used, as is common in patent documents, to include one or more than one, independent of any other instances or usages of "at least one" or "one or more." In this document, the term "or" is used to refer to a nonexclusive or, such that "A or B"

includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims.

Also, in the above detailed description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

I claim:

1. A forming process comprising:

forming a part around one or more first universal dies, by a means applying forming force, to take a shape similar to that of the one or more first universal dies, wherein the one or more first universal dies contain one or more active areas with a first end having a cantilevered area fixed to a base plate near a location that is tangent to the part, and a second end coupled to a bending arm, wherein a curvature of the one or more active areas can be changed while the part is being formed by use of one or more actuators fixed to the baseplate which are acting on the bending arm to cause actuating forces and moments at the active areas that are more than die forces and moments at the active areas, that are caused by the forming force wherein the means of applying forming force acts through one or more second universal dies of shape that mate with the previously said one or more first universal dies, such that the part is clamped between the one or more active areas of the first and second universal dies to form the part to a local curvature of the one or more first and second universal dies, the one or more first and second universal dies and the means of applying forming force together comprising a station.

2. The forming process of claim 1 wherein the one or more first and second universal dies have a compliant material over them so as to accommodate mismatch in the curvatures of the mating dies.

3. The forming process of claim 2 wherein the one or more first and second universal dies are circumscribed by endless belts with elastomeric backing that serves as the compliant material.

4. The forming process of claim 3 wherein the belts are driven in opposite rotational directions around each of the one or more first and second universal dies of a station, so that the belts at a station together pull the part in one direction.

5. A forming process using in series two or more stations of claim 1, the curvatures of each of the active areas of which are changed to form one or more local shapes at different locations along the length of the part, to form the part to the desired curvature at each of these locations.

6. The forming process of claim 5 wherein the part moves through the series of two or more stations, each of which adjusts the curvatures of each of the active areas of the one or more first and second universal dies, to correspond to the local shape required to form area of the part in contact with each of the active areas.

7. The forming process of claim 6 wherein the two or more stations pull the part in opposing directions to generate longitudinal stress within the part.

8. The forming process of claim 7 wherein bending of the part by the two or more stations is assisted by longitudinal tensile stress within the part, which reduces the bending moment required to plastically bend the part.

9. The forming process of claim 7 wherein bending of the part by the two or more stations is assisted by longitudinal compressive stress within the part, which reduces the bending moment required to plastically bend the part.

10. The forming process of claim 8 wherein the stations are arranged into two sets, a set of exit stations that pull the part through, and a set of brake stations that apply an opposing force to the part as if to try to prevent the part from being pulled through the set of brake stations.

11. The forming process of claim 10 wherein the part enters at the beginning of the first brake station and exits at the end of the last exit station.

12. The forming process of claim 11 wherein changes in curvature of each local region of the part occur during the time the local region of the part is within the first exit station.

13. The forming process of claim 12 wherein the position and orientation of each of the exit stations is changed to place these stations at the correct locations and orientations determined by the already established shape of the part, so that they can pull the part without further deformation.

14. The forming process of claim 4 wherein said belts have harder fibers and/or particles embedded in the elastomeric backing, to introduce additional local surface deformation of part, to produce surface finish or properties similar to that of shot peened parts.

15. The forming process of claim 4 wherein the interfaces between the belts and the universal dies contain low friction lubricants that reduce friction between the dies and the belts.

16. The forming process of claim 4 wherein rolling elements are interspersed between the belts and the universal dies to reduce friction between the universal dies and the belts.

* * * * *